US006527242B1

(12) United States Patent
Kennedy

(10) Patent No.: US 6,527,242 B1
(45) Date of Patent: Mar. 4, 2003

(54) BRACE FOR A PICTURE FRAME

(76) Inventor: Netta Kennedy, P.O. Box 307, Holly Hill, SC (US) 29059

( * ) Notice: Subject to any disclaimer, the term of this patent is extended or adjusted under 35 U.S.C. 154(b) by 0 days.

(21) Appl. No.: 09/969,048

(22) Filed: Oct. 1, 2001

(51) Int. Cl.[7] ..... F16M 13/00
(52) U.S. Cl. ..... 248/351; 248/174; 40/754
(58) Field of Search ..... 298/351, 174, 298/459; 40/748, 754, 120, 152.1; 16/225, 227, DIG. 13

(56) References Cited

U.S. PATENT DOCUMENTS

| | | | | | |
|---|---|---|---|---|---|
| 482,978 | A | | 9/1892 | Hunter | |
| 1,798,267 | A | * | 3/1931 | Marsh | 40/603 |
| 1,832,704 | A | * | 11/1931 | Hausner | 40/737 |
| 2,115,448 | A | | 4/1938 | Pradt | |
| 2,388,431 | A | * | 11/1945 | Neiman | 40/152 |
| 3,758,065 | A | * | 9/1973 | Ranseen | 248/459 |
| 4,777,746 | A | * | 10/1988 | Brooks | 40/152.1 |
| 5,056,250 | A | | 10/1991 | Weissleder et al. | |
| 5,291,635 | A | * | 3/1994 | Schmale | 16/371 |
| 5,371,924 | A | * | 12/1994 | Schmale | 16/346 |
| 5,570,526 | A | | 11/1996 | Wallon | |
| 5,873,603 | A | * | 2/1999 | Carless et al. | 283/61 |

* cited by examiner

*Primary Examiner*—Ramon O. Ramirez
*Assistant Examiner*—Kofi Schulterbrandt
(74) *Attorney, Agent, or Firm*—B. Craig Killough

(57) ABSTRACT

A brace for connection to the back, planar surface of a picture frame, and to the surface of the strut that faces the back of the picture frame. One side of the brace is affixed to the back, planar surface of the picture frame, and an opposite side of the brace is attached to the surface of the strut that faces the picture frame. The brace holds the strut in position relative to the picture frame, allowing the strut to support the picture frame. The brace may be used even if the strut is broken at the original attachment point of the strut to the picture frame

6 Claims, 2 Drawing Sheets

BRACE FOR A PICTURE FRAME

FIELD OF THE INVENTION

This invention relates to picture frames generally, and is more specifically directed to a device for bracing easel type picture frames.

BACKGROUND OF THE INVENTION

Picture frames in common use that are designed to be placed on horizontal surfaces, such as tables, shelves, or mantels, have a support which extends from the back of the picture frames. The picture frame is supported by a horizontal lower edge of the picture frame, in combination with the support or strut which extends from the back planar surface of the picture frame. Typically, the length of the structure is such that the front plane of the picture is less than perpendicular to the horizontal plane on which the picture frame is positioned.

The support or strut on the back of the picture frame is frequently designed to be capable of movement relative to the back of the picture frame. This strut may be used to change the angle of the picture frame relative to the horizontal frame, or to allow for positioning of the picture frame. The strut may be attached to the picture frame by means which allows the strut to pivot, or the strut may be formed of a material which flexes relative to the picture frame, to allow some movement and positioning of the strut.

Over time, the strut may weaken at the pivot or hinge point where the strut connects at the picture frame. If the strut weakens at this point, it will no longer support the picture frame, and the picture frame cannot be held in a generally upright position relative to the pivot point or strut. When this breaking or weakening of the strut occurs, the picture frame is no longer usable as a stand-alone picture frame, which may be positioned on a shelf, table, or other horizontal surface.

SUMMARY OF THE PRESENT INVENTION

The present invention is a brace that is connected to the back, planar surface of the picture frame, and to the surface of the strut that faces the back of the picture frame. One side of the brace is affixed to the back, planar surface of the picture frame, and an opposite side of the brace is attached to the surface of the strut that faces the picture frame. The brace holds the strut in position relative to the picture frame, allowing the strut to support the picture frame. The brace may be used even if the strut is broken at the original attachment point of the strut to the picture frame.

DETAILED DESCRIPTION OF THE PREFERRED EMBODIMENT

Figure 1:
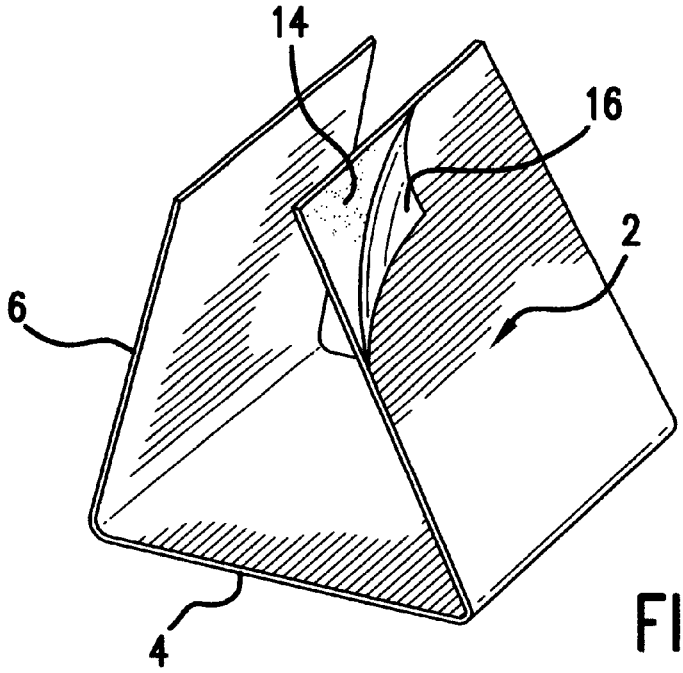
FIG. 1 is a perspective view of the picture frame brace.

Referring now to the drawing figures, FIG. 1 shows the picture frame brace having a first side 2, a second side 4, and a third side 6. The first side opposes a third side, and the first side and the third side are connected by the second side, as show in the drawing figure. The picture frame support or brace could have one or more additional sides, although in the preferred embodiment, the device has three sides as shown.

In the preferred embodiment, the first side joins the second side at an angle of less than 90°. Also, as shown in the preferred embodiment, the third side joins the second side at an angle of less than 90°.

Figure 2:
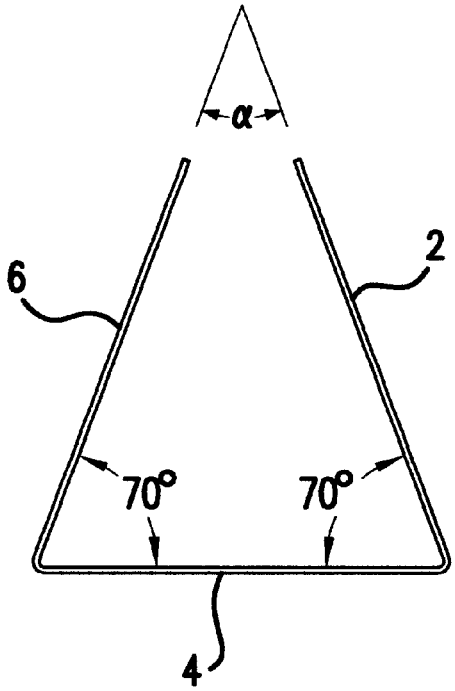
FIG. 2 is an elevation of the picture frame brace.
Figure 3:
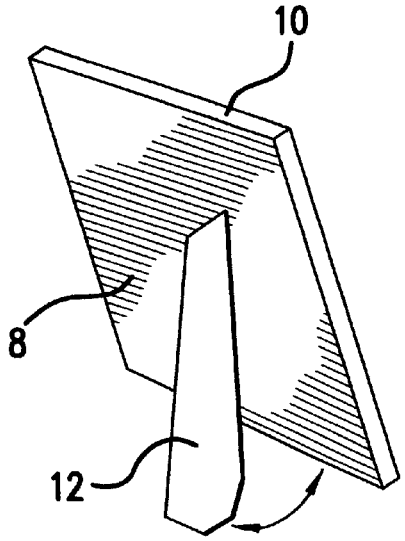
FIG. 3 is a perspective view demonstrating a picture frame having a strut on the back thereof, prior to attachment of the picture frame brace.

What is critical to the invention is, however, that the relative angle between the first side and the third side is less than 60°, and is usually 45° or less. As used herein, the term "relative angle" is the angle $\alpha$ between the first side and the third side, if the sides were extended linearly from the position as shown in FIG. 2, so that the sides would intersect. The angle at this demonstrated point of intersection must be not more than 60°.

Figure 4:
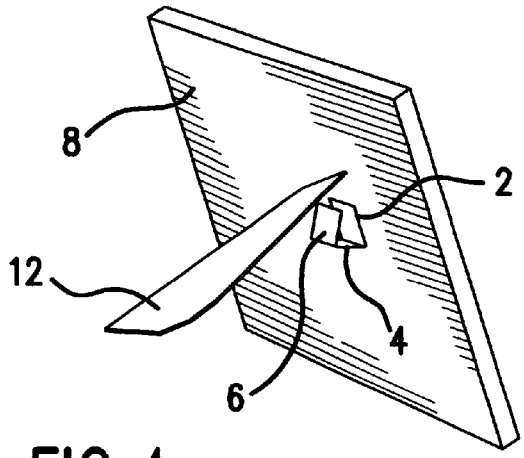
FIG. 4 demonstrates the attachment of the brace to the picture frame between the back planar surface of the picture frame and the strut.

Attaching either the first or third side of the brace to the back planar surface 8 of the picture frame 10, and attaching the opposite side of the brace to the surface of the strut 12 that faces the back planar surface of the picture frame fixes the brace to the picture frame. FIG. 4. When the support or brace is so attached, it holds the support or brace in position relative to the picture frame, so that the strut can support the picture frame.

Various means of attachment of the first side and the third side of the brace to the picture frame and strut may be used. Adhesives or hook and loop material, for example, may be used, as could fasteners.

In the preferred embodiment, an adhesive material is used to attach the brace. It is preferred for the material from which the brace is formed to have an adhesive 14 coated on an outside surface of the material, with a covering layer 16, such as that used with pressure sensitive materials, like bumper stickers, covering the adhesive until the device is ready for use. Once the device is ready for use, the covering layer may be removed, and the adhesive coated surface affixed to the picture frame and the strut.

Figure 5:
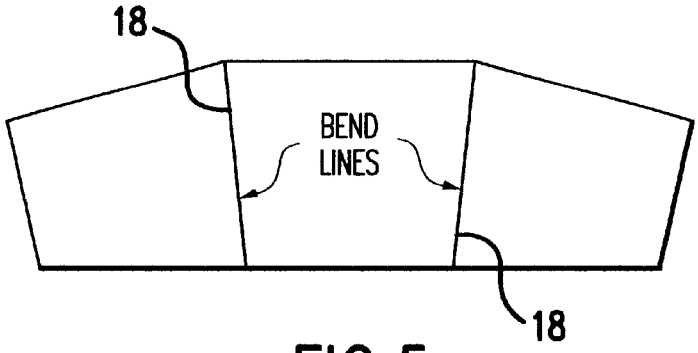
FIG. 5 demonstrates one embodiment of the formation of the picture frame brace.

The device may be formed of various materials. The device may be formed of moulded plastic and provided in the shape shown in FIG. 2. In a preferred embodiment the device is provided in a flat plane, with bend lines 18 formed, scored or molded in the flat plane to facilitate bending of the flat plane, to form the first side and the third side relative to the second side. FIG. 5. Adhesive material is provided as described above on one surface of the flat plane, which forms the exterior of the brace, and is not provided on the opposite surface, which forms the opposite surface. The flat plane is then bent and formed as shown in FIG. 2 with the angle of the first side and third side relative to the second side as desired and needed by the application. The flat plane may be formed of various materials, including paper, plastics or metals. Materials which may be manually formed, but which have a memory once formed are particularly useful. For example, a flat plane of aluminum having lines formed or scored therein could be formed manually to the generally triangular shape of FIG. 2, with the aluminum retaining its shape after formation. Again, an adhesive may be coated on one side of the aluminum, with a covering applied over the adhesive until the device is ready for use, and is applied in a pressure sensitive manner.

What is claimed is:

1. A brace for a picture frame, comprising, a first side, a second side and a third side, wherein, in use, said first side is opposite said third side, and said first side extends upwardly from said second side, and said third side extends upwardly from said second side, and said second side joins said first side and said third side, and wherein said first side is not connected to said third side on an upper end of said first side and an upper end of said second side, and wherein at least one of said first side and said third side each meet said second side at an acute angle, and an outer surface of said first side is formed to attach to a back side of a picture frame and an outer surface of said third side is formed to attach to a picture frame strut.

2. A brace for a picture frame as described in claim 1, wherein said first side has an adhesive thereon and said first side is formed to attach and adhere to a back side of a picture frame, and wherein said third side has an adhesive thereon, and said third side is formed to attach and adhere to a picture frame strut.

3. A brace for a picture frame as described in claim 1, wherein, in use, said second side is generally horizontal.

4. A brace for a picture frame as described in claim 1 wherein, in use, the relative angle between said first side and said third side is an acute angle, and the relative angle between said first side and said second side is an acute angle and the relative angle between said second side and said third side is an acute angle.

5. A brace for a picture frame as described in claim 3, wherein, in use, the relative angle between said first side and said third side is an acute angle, and the relative angle between said first side and said second side is an acute angle and the relative angle between said second side and said third side is an acute angle.

6. A brace for a picture frame as described in claim 1, wherein said first side, said second side and said third side are formed as a unitary member from a single sheet of material.

* * * * *